United States Patent [19]

Sakuma et al.

[11] 4,410,777

[45] Oct. 18, 1983

[54] VACUUM CIRCUIT INTERRUPTER

[75] Inventors: Shinzo Sakuma, Yokohama; Junichi Warabi, Shizuoka; Yukio Kobari, Tokyo, all of Japan

[73] Assignee: Kabushiki Kaisha Meidensha, Tokyo, Japan

[21] Appl. No.: 266,391

[22] Filed: May 22, 1981

[30] Foreign Application Priority Data

May 23, 1980 [JP] Japan ..... 55-68453
May 23, 1980 [JP] Japan ..... 55-68454

[51] Int. Cl.[3] ..... H01H 33/66
[52] U.S. Cl. ..... 200/144 B
[58] Field of Search ..... 200/144 B

[56] References Cited

U.S. PATENT DOCUMENTS 3,727,018 4/1973 Wesoloski et al. ..... 200/144 B
3,812,314 5/1974 Nonken ..... 200/144 B

FOREIGN PATENT DOCUMENTS 1298448 12/1972 United Kingdom ..... 200/144 B
2010587 6/1979 United Kingdom ..... 200/144 B

*Primary Examiner*—Robert S. Macon
*Attorney, Agent, or Firm*—Lowe, King, Price & Becker

[57] ABSTRACT

A vacuum interrupter has a bell-shaped metal casing made of copper or stainless steel with a copper, ring-shaped stress reduction member sandwiched between an open end of the casing and the outer periphery of a ceramic insulation disk. Since copper is plastically deformable, thermal stress generated during cooling down to room temperature following brazing of the metal casing to the ceramic insulation disk is substantially reduced, resulting in increased brazing strength so that the wall thickness of the casing can be increased. Further, since copper and stainless steel are not ferromagnetic materials, it is possible to reduce eddy currents and magnetostrictive vibration in the casing.

11 Claims, 11 Drawing Figures

VACUUM CIRCUIT INTERRUPTER

BACKGROUND OF THE INVENTION

1. Field of the Invention

The present invention relates to a vacuum circuit interrupter and more specifically to an improved vacuum circuit interrupter having a ceramic insulation disk having a bell-shaped casing made of copper to reduce increases in temperature and sound noise caused by eddy currents and magnetostrictive vibration, as well as to facilitate the initial assembly before the circuit interrupter is heated within a vacuum furnace for brazing.

2. Description of the Prior Art

In the conventional vacuum circuit interrupter, the bell-shaped casing is generally made of Fe-Ni-Co or Fe-Ni alloy, because it is preferable to use a metal having a thermal expansion coefficient similar to that of the alumina-group ceramic forming the insulation disk joined to the casing.

However, since there is a small difference in thermal expansion coefficient between the Fe-Ni-Co or Fe-Ni alloy which forms the casing and the ceramic which forms the insulation disk, and since thermal stress is produced when the two materials are brazed together, it is impossible to increase the wall thickness of the casing, that is the thickness of the opening end surface of the casing to which the insulation disk is joined and to increase the mechanical strength, and therefore it is necessary to absorb or reduce both thermal stress generated in the cooling process after brazing and mechanical shock generated from closing or opening the circuit, by providing a flange for the casing.

In addition, since the Fe-Ni-Co or Fe-Ni alloy used for the casing is a ferromagnetic material, the eddy currents generated by current flowing therethrough raises the temperature of the casing, thus preventing the interrupter from being used as a large-current circuit interrupter. The smaller the diameter of the casing, the greater the eddy current, and therefore it is very difficult to design a small vacuum circuit interrupter. Further, there is another serious problem such that the alternating magnetic field generated by the current of a commercial frequency flowing therethrough generates magnetostrictive vibration and thus produces resulting sound noises from the casing.

Further, since the Fe-Ni-Co alloy used for the casing is expensive, hard to work, and poor in ductility and malleability, there is another problem such that it is necessary to restrict the wall thickness and the size of the casing.

Furthermore, in the above-mentioned vacuum circuit interrupter, there is a problem such that it is very difficult to support the contacts, especially the fixed contact, when the interrupter is initially assembled during the manufacturing process, before the vacuum circuit interrupter is heated within a vacuum furnace for brazing.

SUMMARY OF THE INVENTION

With these problems in mind, therefore, it is a primary object of the present invention to provide a vacuum circuit interrupter wherein (1) the brazing strength between the casing and the insulation disk can be improved markedly by reducing thermal stress generated in the cooling process down to room temperature after the casing has been brazed to the ceramic insulation disk; (2) the wall thickness of the casing can be increased; and (3) eddy currents and magnetostrictive vibrations caused by current flowing through the circuit interrupter can be reduced.

To achieve the above-mentioned objects, the vacuum circuit interrupter according to the present invention comprises a bell-shaped metal casing at least the open end of which is made of copper and joined hermetically by brazing to the outer periphery of a ceramic insulation disk. Since the open end of the bell-shaped metal casing is made of copper that deforms plastically, the thermal stress generated in the cooling process down to room temperature, which follows the process of brazing the metal casing to the ceramic insulation disk, can be reduced markedly, with the result that the brazing strength between the two elements can be improved effectively.

In the vacuum circuit interrupter according to the present invention, the bell-shaped casing is made of copper or of stainless steel with a copper ring-shaped stress reduction member sandwiched between the opening end of the casing and the outer periphery of the ceramic insulation disk.

BRIEF DESCRIPTION OF THE DRAWINGS

The features and advantages of the vacuum circuit interrupter according to the present invention will be more clearly appreciated from the following description taken in conjunction with the accompanying drawings in which like reference numerals designate corresponding elements and in which.

DETAILED DESCRIPTION OF THE PREFERRED EMBODIMENTS

Figure 1:
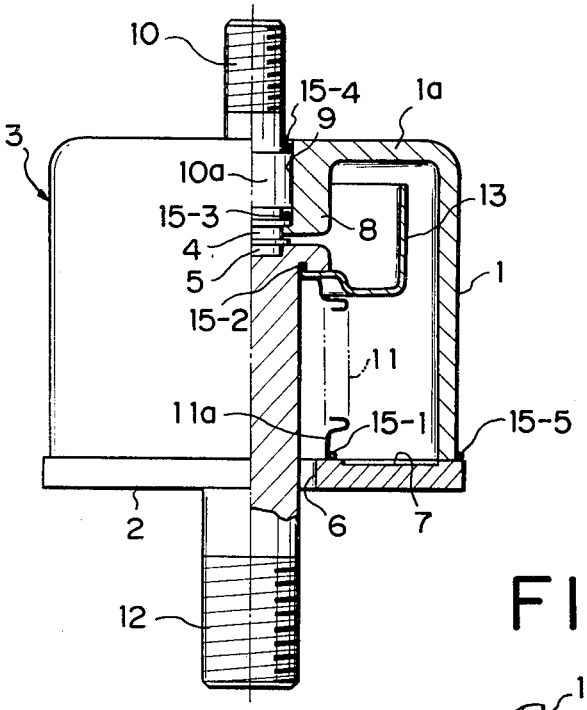
FIG. 1 is an elevational view partly in section of a first embodiment of the vacuum circuit interrupter according to the present invention.

Referring now to FIG. 1 there is shown a vaccum circuit interrupter according to the present invention, in which the opening portion of a metal bell-shaped casing 1 is closed by a ceramic insulation disk 2 from the underside to form a chamber 3, and a pair of fixed and movable contacts 4 and 5 are provided within the vacuum vessel 3 so as to freely make and break an electric circuit.

Insulation disk 2 is formed from alumina-group ceramic material, and there is provided a hole 6 extending axially through center of the disk 2 (the vertical direction in FIG. 1) and also a metallized layer (not shown) formed from a metal having approximately the same thermal expansion coefficient as that of the ceramic material such as a Mo-Mn-Ti or a Mn-Ti alloy on the upper surface near the hole 6 and the upper, outer periphery of the disk 2. Also, a number of 0.1–0.5 mm deep grooves 7 are formed between the metallized layers on the upper surface of the insulation disk 2 in order to reduce the area of the ground surface on which the metallized layer is formed.

To the insulation disk 2, the casing 1 which forms the chamber vessel 3 together with the disk 2 is joined by vacuum brazing with the opening end of the casing 1 closely brought into contact with the metallized layer near the outer periphery of the disk 2.

The bell-shaped casing 1 is formed from a pressing of a copper block so as to have a relatively large wall thickness to increase the mechanical strength, and a contact mounting portion 8 is integrally formed with the casing 1 at the center of the top 1*a* thereof projecting inward.

Figure 2:
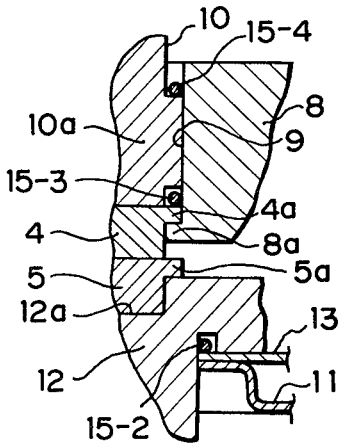
FIG. 2 is an expanded sectional view of the first embodiment of the vacuum circuit interrupter according to the present invention.

In the contact mounting portion 8, there is provided a hole 9 made axially therethrough and a stop flange 8*a* projecting in the radial direction like a ring is provided inside the contact mounting portion 8, as depicted in FIG. 2.

In the contact mounting portion 8, the above-mentioned roughly-round fixed contact 4 with a stop flange 4*a* is fitted into a hole 9 projecting into the vacuum chamber 3, and the stop flange 4*a* is fixed in close contact with the stop flange 8*a* of the contact mounting portion 8 of the casing 1 by vacuum brazing.

In the hole 9 of the contact mounting portion 8, a steel casing-mounting bolt 10 is fixed by brazing with its larger-diameter part 10*a* fitting tightly against the inner surface of the hole 9.

Within vacuum chamber 3, a stainless-steel bellows 11 is housed concentrically therewith, and the cylindrical part of the bellows 11 extending axially is joined hermetically to the metallized layer provided near the hole 6 on the insulation disk 2 by vacuum brazing.

Within vacuum chamber 3, a movable electrode rod 12 is loosely inserted into the center of the hole 6 and the bellows 11 in such a way that the rod can freely move in the axial direction.

To the lower end of the large-diameter part of the rod 12, the other end of the bellows 11 extending in the radial direction thereof is fixed hermetically by vacuum brazing.

In a recess 12*a* provided at the top of the movable electrode rod 12, the above-mentioned roughly round movable contact 5 having a similar stop flange 5*a* to that of the fixed contact 4 is fitted and joined by brazing.

A cup-shaped shield 13 is provided to catch metal vapour produced when the fixed and movable contacts 4 and 5 are brought into contact with or away from each other, to prevent the metal vapor adhering to the insulation disk 2 and the bellows 11. The shield is made of steel, stainless steel, or copper, the opening of which faces the top 1*a* of the casing 1, and is fixed by brazing to the lower end of the movable electrode rod 12 through a hole provided in the bottom of the shield 13.

Figure 3:
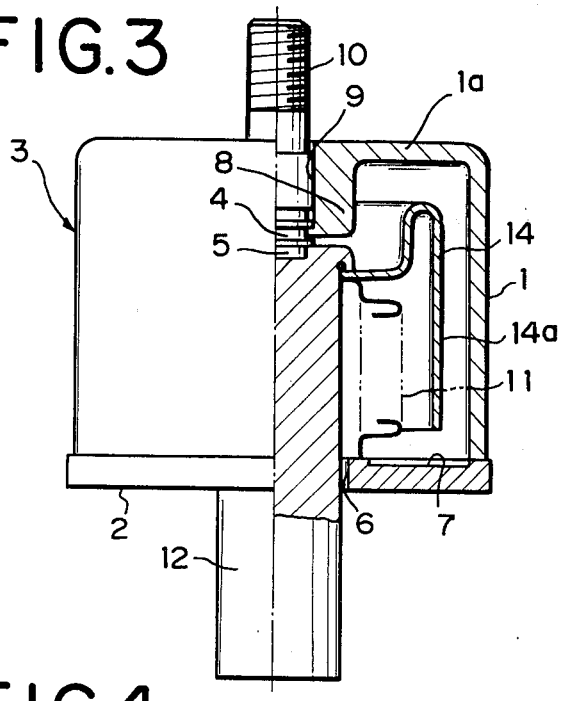
FIG. 3 is an elevational view partly in section of a second embodiment of the vacuum circuit interrupter according to the present invention.

Without being limited to the above-mentioned shape, it is possible to provide a different shield such as the shield shown in FIG. 3 in which a second embodiment is illustrated. In this embodiment, the shield 14 is formed like a bell with a recessed top and is fixed to the upper end of the movable electrode rod 12, in the same manner as the shield 13. The opening end portion facing the top 1*a* of the casing 1 is bent upwards with the top formed in a cup shape, and a cylindrical bellows-surrounding part 14*a* is integrally formed therewith. Therefore, it is possible to reduce the adhesion of metal vapor onto the bellows 11 more effectively.

In order to manufacture the vacuum circuit interrupter described above, ceramic insulation disk 2 is first supported horizontally with the metallized layer facing upward. Stainless steel bellows 11 is then placed at the center of insulation disk 2 with brazing metal 15-1 disposed on the metallized layer provided near the hole 6 of the insulation disk 2, as shown in FIG. 1. Next, the shield 13 or 14 is fitted near the flange of the movable electrode rod 12 through a hole provided in the top of the shield, and brazing metal 15-2 is disposed near the hole to perform initial assembly. The movable electrode rod 12 with the movable contact 5 at the top thereof with some more brazing metal (not shown) disposed therebetween is inserted into the bellows 11, and the top flange of the movable electrode rod 12 is placed onto the top end of the bellows 11 with brazing metal 15-2 disposed therebetween.

In this case, it is preferable to use only that brazing metal disposed at appropriate positions in order to braze the movable electrode rod 12, bellows 11, and shield 13 or 14 together.

A block of copper is press-formed into a bell shape; the contact mounting 8 is formed at the center of the inner top thereof; the hole 9 having the stop flange 8*a* is provided in the contact mounting 8 of the casing 1. The fixed contact 4 is fixed to the hole 9 of the contact mounting portion 8 by the brazing metal 15-3; the casing mounting bolt 10 is fixed to the casing 1 by brazing metal 15-4 disposed in position in the same manner as described above; more brazing metal 15-5 is disposed on the metallized layer near the end surface of the opening of the casing 1 and the periphery of the insulation disk 2, thus the initial assembly of the vacuum circuit interrupter is finished.

The vacuum circuit interrupter temporarily assembled as described above is now heated within a vacuum furnace to a temperature of approximately 950° to 1050° C. to reduce the air pressure to $10^{-4}$ Torr or less, thereby the degassing the parts and providing airtight sealing simultaneously. The vacuum circuit interrupter is complete when taken out of the vacuum furnace after the furnace temperature has been gradually cooled down to room temperature.

The above-mentioned circuit interrupter can also be manufactured by the following method, as well as by the manufacturing method of the first embodiment.

The ceramic insulation disk 2 is horizontally supported so that the metallized layer faces upward. Next, in the same way as in the first method, the bellows 11, the movable electrode rod 12, and the shield 13 are mounted one after another to the insulation disk 2 with brazing metal placed in position, thereby initially assembling the movable side.

The temporarily assembled movable side is heated to a temperature of 950°-1050° C. within a vacuum furnace to reduce the gas pressure to $10^{-4}$ Torr or less or a reduction gas atmosphere such as hydrogen gas thus performing the degassing of parts and the airtight sealing simultaneously.

Next, the fixed side of the casing 1, to which the fixed contact 4 and the casing mounting bolt 10 are initially assembled with brazing metals disposed in position, is placed on the insulation disk of the movable side which has already been degassed and brazed, and brazing metal 15-5 is disposed near the end surface of the opening of the casing 1 and on the metallized layer of the outer periphery of the insulation disk 2, thus the circuit interrupter is temporarily assembled.

The interrupter initially assembled as described above is next heated to a temperature of 500°-1050° C. within a vacuum furnace to reduce the gas pressure to $10^{-4}$ Torr or less thus performing the degassing of parts and the airtight sealing simultaneously. The vacuum circuit interrupter is complete when taken out from the vacuum furnace after the furnace temperature has been cooled gradually down to room temperature.

Further, in each manufacturing method described above, it is possible to reduce the lower limit of the heating temperature to 950° C. or less by previously plating nickel or brazing auxiliary metal of copper onto the brazing part of the stainless steel bellows.

Further, in the case when Fe, Fe-Ni-Co, or Fe-Ni alloy is not used for the components it is possible to seal it hermetically by using a brazing metal including silver, since there will be no cracks due to stress erosion at the hermetically sealed parts.

Now, it has been regarded that it is desirable to select a metal having the same thermal expansion coefficient as that of ceramic material in order to increase the reliability of the airtight sealing between the ceramic and metal. However, in the embodiment according to the present invention, it is possible to increase the reliability of the airtight sealing between the copper casing 1, the stainless steel bellows 11, and the insulation disk 2, in spite of the fact that the thermal expansion coefficients differ greatly from each other.

Figure 11:
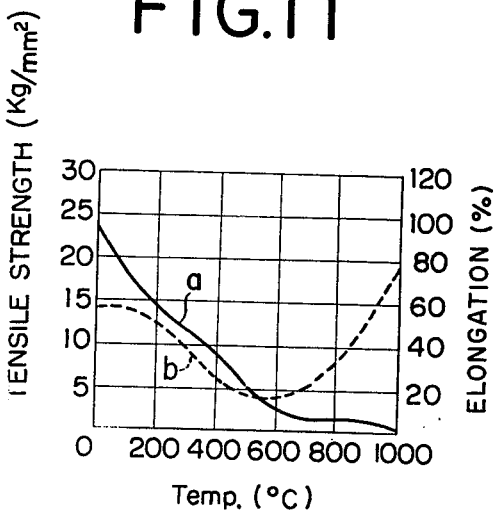
FIG. 11 is a graphical representation of the relationships between the tensile strength and elongation of copper, and temperature.

This may be due to the following facts: since the relationship between temperature (°C.) and the tensile strength (Kg/mm$^2$) of copper and the relationship between temperature (°C.) and the elongation (%) are shown by the solid line (a) and the dashed line (b) respectively in FIG. 11, even if the copper casing 1 is brazed hermetically to the ceramic insulation disk 2 at a high temperature, for instance, at 500° C. or more, the tensile strength of copper is remarkably small compared with that of the ceramic material. Therefore, plastic deformation is repeated in the cooling process down to room temperature within the vacuum furnace, and thus the thermal stress is reduced to such a degree that there is no harmful effect upon the mechanical strength of the circuit interrupter.

Further, since the stainless steel bellows 11 is in general as thin as 0.1 to 0.2 mm and the thermal stress is remarkably small compared with the strength of the ceramic insulation disk 2, the bellows itself can deform plastically or elastically without destroying the sealing joining it to the insulation disk 2, thus it is possible to sufficiently withstand the shock generated whenever the contacts are brought into contact with or away from each other.

Figure 4:
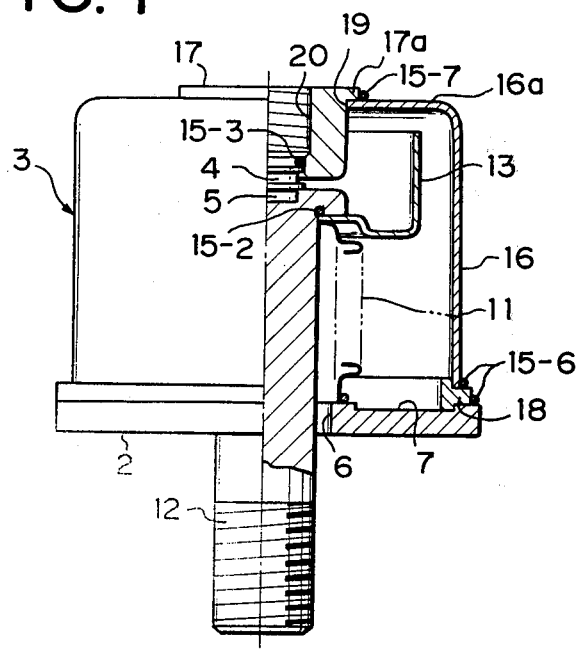
FIG. 4 is an elevational view partly in section of a third embodiment of the vacuum circuit interrupter according to the present invention.

FIG. 4 shows another embodiment according to the present invention. The points different from the first embodiment are that the casing 16 defining vacuum chamber 3 is formed of a metal having a higher mechanical strength, and the contact mounting member 17 fixed to the casing 16 is independently provided. Otherwise, the same component parts as in the first embodiment are designated by the same reference numerals and the description thereof is omitted herein.

Figure 5:
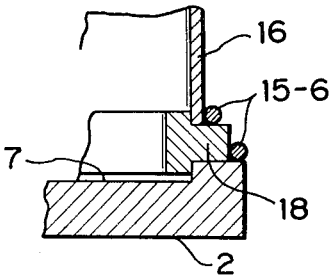
FIGS. 5 and 6 are expanded sectional views of the third embodiment of the vacuum circuit interrupter according to the present invention.

The stainless steel bell-shaped casing 16 is joined hermetically to periphery of the insulation disk 2 with a copper ring-shaped stress reduction member 18 additionally disposed between the end surface of the opening end casing 16 and the metallized layer on insulation disk 2. Stress reduction member 18 can deform plastically when cooled gradually after the two members have been joined by vacuum brazing so as to absorb or reduce the thermal stress due to differences in thermal expansion coefficient between casing 1 and insulation disk 2. As shown in FIG. 5, the stress reduction member 18 is provided with a flange formed so as to fit between the groove 7 and the opening end of the casing 16, and the casing 16 and the insulation disk 2 are joined to each other hermetically by using two bands of brazing metal 15-6 disposed near the respective connections.

At the top center of the casing 16, there is provided a hole 19 in which a copper contact mounting member 17 is fitted to project into the vessel. The contact mounting member 17 is brazed to the top 16*a* of the casing 16 by using the stop flange 17*a* provided at the end of the mounting member 17, with brazing metal 15-7 disposed in position.

Figure 6:
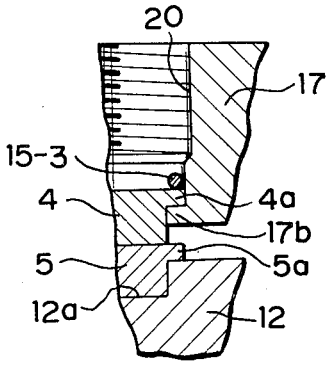

As depicted in FIG. 6, an axial female threaded hole 20 is provided in the contact mounting member 17, and a ring-shaped stop flange 17*b* projecting radially inward thereof is provided on the inner surface of the threaded hole 20. In the threaded hole 20 of the contact mounting member 17, the fixed contact 4 is fitted projecting into the vacuum chamber 3, and the stop flange 4*a* is brought into contact with the stop flange 17*b* to join them hermetically by brazing.

In order to manufacture the above-mentioned vacuum circuit interrupter, in the same way as in the first embodiment, first the respective brazing metals 15 are first disposed near the various member-joining portions, as shown in FIG. 4, to initially assemble the circuit interrupter.

The temporarily assembled vacuum interrupter is heated to a temperature of 950°-1050° C. within a vacuum furnace to reduce the gas pressure to $10^{-4}$ Torr or less thus performing the degassing and airtight sealing. That is, the desired vacuum interrupter is completed by performing a single brazing heating.

Otherwise, the movable side temporarily assembled with brazing metals and the metalcase portion which has been initially assembled with a metalcase, a contact mounting member and a stress reduction member with brazing metals disposed in position is heated to a temperature of 950°-1050° C. within a vacuum furnace to reduce the gas pressure to $10^{-4}$ Torr or less or a reduction gas atmosphere such as hydrogen gas thus performing the degassing and airtight sealing simultaneously.

Next, the fixed side which has been initially assembled by disposing brazing metal in position is assembled with the movable side to initially assemble the whole circuit interrupter. The initially assembled whole circuit interrupter is then heated to a temperature of 500°-1050° C. within a vacuum furnace to reduce the gas pressure to $10^{-4}$ Torr or less thus performing the degassing and the airtight sealing simultaneously. That is, the desired circuit interrupter is completed by performing the brazing heating twice.

Figure 7:
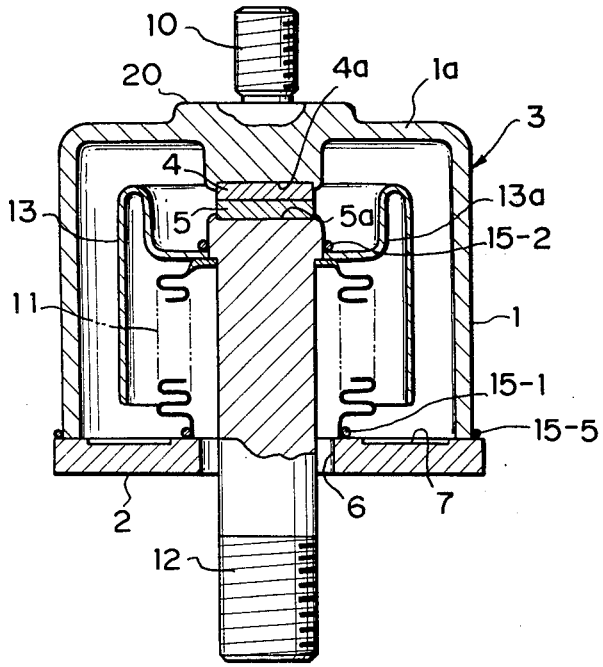
FIG. 7 is an elevational sectional view of a fourth embodiment of the vacuum circuit interrupter according to the present invention.

FIG. 7 shows a fourth embodiment of the vacuum circuit interrupter according to the present invention, wherein the opening of a metal bell-shaped casing 1 is closed by a ceramic insulation disk 2 to form a chamber vessel 3, and a pair of fixed and movable contacts 4 and 5 respectively are provided within vacuum chamber 3 so as to freely make and break an electric circuit.

Figure 8:
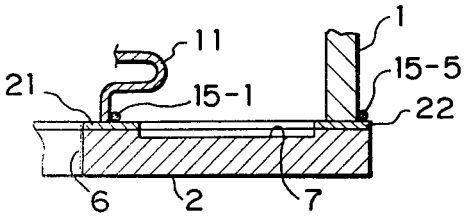
FIG. 8 is an expanded sectional view of the fourth embodiment of the vacuum circuit interrupter according to the present invention.

In the insulation disk 2 made of alumina-group ceramic material, there is provided a hole 6 made axially through the center of the disk 2 (the vertical direction in FIG. 7) and also metallized layers 21 and 22, formed from a metal having approximately the same thermal expansion coefficient as that of the ceramic material such as a Mo-Mn-Ti or Mn-Ti alloy, on the upper surface near the hole 6 and the upper, outer periphery of the disk 2, as shown in FIG. 8. Also, a number of 0.1–0.5 mm deep grooves 7 are provided between the metallized layers 21 and 22 on the upper surface of the insulation disk 2 in order to reduce the area of the ground surface on which the metallized layer is formed.

To the insulation disk 2, the casing 1 which forms the chamber vessel 3 together with the disk 2 is joined by vacuum brazing with the end of the opening of the casing 1 closely brought into contact with the metallized layer near the outer periphery of the disk 2.

The bell-shaped casing 1 is formed by pressing a copper block so as to have a relatively large wall thickness to increase the mechanical strength, and a contact mounting portion 8 is integrally formed with the casing 1 at the center of the top 1*a* thereof projecting inward.

On one surface of the contact mounting portion, a recess 4*a* is provided. The fixed contact 4 is fitted into the recess 4*a* and fixed by brazing with an appropriate upward projection.

At the center of the outside of the top 1*a* of the casing 1, a round current collection portion 20 is formed integrally with the casing. At the center of the current collection portion 20, a bolt-like casing mounting portion 10 is provided to fix the vacuum circuit interrupter to an appropriate position.

Within the above-mentioned vacuum chamber 3, a stainless bellows 11 is housed concentrically therewith, and the end of the lower cylindrical part of the bellows 11 extending axially is joined hermetically to the metallized layer 21 near the hole 6 of the insulation disk 2 by vacuum brazing.

Within vacuum chamber 3, a movable electrode rod 12 having a movable contact 5 is loosely inserted into the center of the hole 6 and the bellows 11 in such a way that the rod can freely move in the axial direction.

To the lower end of a large-diameter part of the rod 12, the other end of the bellows 11 extending in the radial direction thereof is fixed hermetically by vacuum brazing.

The movable contact 5 is fitted into a contact fixing recess 5*a* provided at the top center of the movable electrode rod 12 and is fixed by brazing. The movable contact 5 is brought into contact with or away from the fixed contact 4 whenever the movable electrode rod 12 is moved up or down.

As shown in FIG. 7 a bell-shaped shield 13 is provided. Shield 13 includes a recessed top to catch metal vapour produced when the fixed and movable contacts 4 and 5 are brought into and out of contact with each other. Shield 13 prevents the metal vapor from adhering to insulation disk 2 or bellows 11. Being made of steel, stainless steel, or copper, shield 13 is bell shaped, and the top portion thereof is formed as a recess to provide a contact surrounding portion 13*a*. The shield 13 is concentrically fitted and fixed by brazing to the movable electrode rod 12 through a hole provided at the center of the top of the contact surround 13*a*.

In order to manufacture the vacuum circuit interrupter described above ceramic insulation disk 2 with a hole at the center is first supported horizontally with the metallized layers 21 and 22 facing upward. Stainless steel bellows 11 is next placed at the center of insulation disk 2 with brazing metal 15-1 disposed near the lower part of the bellows 11 and on the metallized layer provided near the hole 6 of insulation disk 2, as shown by FIGS. 7 and 8. The movable electrode rod 12 having the movable contact 5 in the top thereof with more brazing metal (not shown) disposed therebetween is then inserted into bellows 11, and the top end of rod 12 is placed onto the top end of bellows 11 with brazing metal 15-1 disposed in position.

The shield 13 is then fitted near the top of the movable electrode rod 12 through a hole provided in the top of the shield, and brazing metal 15-2 is disposed near the hole for initial assembly thereof.

A block of copper is press-formed into a bell shape; the contact mounting portion 8 is formed at the center of the inner top thereof. The fixed contact 4 is fixed to the end of the contact mounting portion 8 with brazing metal (not shown) and the casing 1 is placed onto the insulation disk 2 with brazing metal 15-5 disposed on the metallized layer near the end surface of the opening of the casing 1 and on the periphery of the insulation disk 2, thus the initially assembling of the circuit interrupter.

The vacuum circuit interrupter is now heated within a vacuum furnace to a temperature of approximately 950° to 1050° C. to reduce the air pressure to $10^{-4}$ Torr or less to degas the parts and provide airtight sealing simultaneously. The vacuum circuit interrupter is complete when taken out of the vacuum furnace after the furnace temperature has been cooled gradually down to room temperature.

The vacuum circuit interrupter can also be manufactured by the following method, as well as by the above-mentioned manufacturing method.

The ceramic insulation disk 2 having a hole at the center thereof is horizontally supported so that the metallized layers 21 and 22 face upward. Next, in the same way as in the first method, the bellows 11, the movable electrode rod 12, and the shield 13 are mounted one after another to the insulation disk 2 with brazing metal placed in position, thereby initially assembling the movable side.

The temporarily assembled movable side is heated to a temperature of 950°–1050° C. within a vacuum furnace to reduce the gas pressure to $10^{-4}$ Torr or less; or a reduction gas atmosphere such as hydrogen gas thus performing the degassing of parts and the airtight sealing simultaneously.

Next, the fixed side of the copper casing 1, which is formed by press-forming processes so as to have a contact mounting portion 8 projecting at the center of the top thereof, and is temporarily assembled with brazing metal disposed near the end of the contact mounting portion 8, is assembled to the insulation disk 2 of the movable side which has already been degassed and brazed, and brazing metal 15-5 is disposed near the end surface of the opening of the casing 1 and on the metallized layer of the outer periphery of the insulation disk 2, thus the circuit interrupter is initially assembled.

The interrupter is next heated to a temperature of 500°-1050° C. within a vacuum furnace to reduce the gas pressure to $10^{-4}$ Torr or less thus performing the degassing of parts and the airtight sealing simultaneously. The vacuum circuit interrupter is complete when taken out of the vacuum furnace after the furnace temperature has been cooled gradually down to room temperature.

Figure 9:
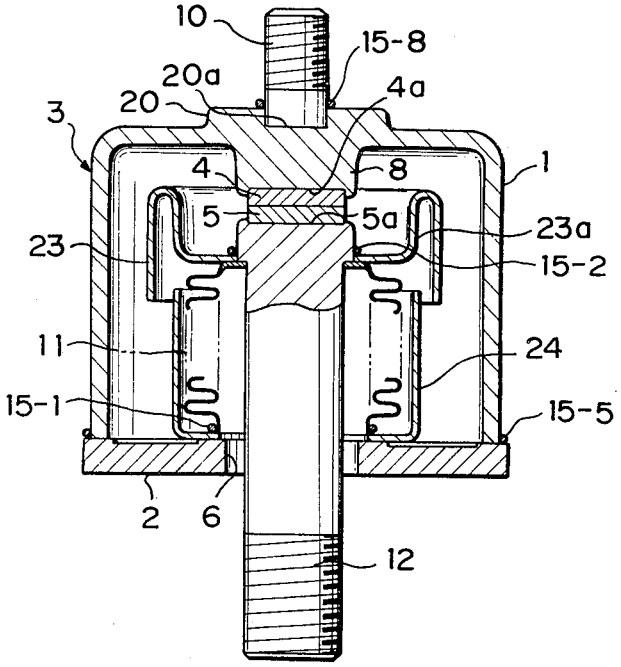
FIG. 9 is an elevational sectional view of a fifth embodiment of the vacuum circuit interrupter according to the present invention.

FIG. 9 shows a fifth embodiment according to the present invention. The points different from the fourth embodiment are the casing mounting portion and the shield structure. Otherwise, the same component parts as in the fourth embodiment are designated by the same reference numerals and the description thereof is omitted herein.

In the current collection part 20 of the casing 1 of the vacuum chamber 3, a recess 20*a* which opens outwards is provided at the center thereof. In this recess 20*a*, the base of the case mounting member 10 is fitted and fixed by brazing.

Further, there are provided two separate shields, that is, a bell-shaped shield with a recessed top 23 mounted on the movable electrode rod 12 and a cylindrical bellows shield 24 mounted on insulation disk 2.

The shield 23 mainly catches metal vapor produced when the fixed and movable contact 4 and 5 are brought into and out of contact with each other. Shield 23 is made of iron, stainless steel, or copper, and the top of it is recessed toward the opening direction to form the contact surrounding portion 23*a*. The shield 23 is fitted and fixed by brazing to the movable electrode rod 12 through a hole provided at the center of the bottom of the contact surrounding portion 23*a* in such a manner as to surround the fixed and movable contacts 4 and 5.

Figure 10:
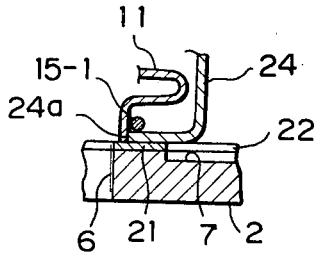
FIG. 10 is an expanded sectional view of the fifth embodiment of the vacuum circuit interrupter according to the present invention.

The bellows shield 24 prevents metal vapour from adhering to the bellows 11, being made of copper, Fe-Ni-Co alloy or Fe-Ni alloy. The cylindrical bellows shield 24, as shown in FIG. 10, is fixed to one end of the bellows 11 through a hole 24*a* provided at the center of the bottom thereof, and is joined hermetically with brazing metal 15-1 disposed onto the metallized layer 21 near the hole 6 of the insulation disk 2.

In order to manufacture the above-mentioned vacuum circuit interrupter, in the same way as in the first method, first brazing metal 15 is disposed near the various member-joining portions, as shown in FIG. 9, to initially assemble the vacuum interrupter.

The initially assembled vacuum circuit interrupter is heated to a temperature of 950°-1050° C. within a vacuum furnace to reduce the gas pressure to $10^{-4}$ Torr or less thus performing the degassing and airtight sealing. That is, a desired vacuum circuit interrupter is completed by performing a single brazing heating.

Otherwise, the movable side initially assembled with brazing metal disposed in position is heated to a temperature of 950°-1050° C. within a vacuum furnace to reduce the gas pressure to $10^{-4}$ Torr or less or a reduction gas atmosphere such as hydrogen gas thus performing the degassing and airtight sealing simultaneously.

Next, the fixed side which has been initially assembled by disposing brazing metal in position is assembled with the movable side to initially assemble the vacuum circuit interrupter. The initially assembled vacuum circuit interrupter is then heated to a temperature of 500°-1050° C. within a vacuum furnace to reduce the gas pressure to $10^{-4}$ Torr or less thus performing the degassing and the airtight sealing simultaneously. That is, a desired vacuum circuit interrupter is completed by performing the brazing heating twice.

As described above, according to the present invention, since the casing defining the vacuum chamber is made of copper, it is possible to manufacture the casing easily with various thicknesses and shapes by press-forming processes, without any rise in casing temperature due to eddy currents caused by alternating magnetic flux of the current flowing therethrough, and further without noise produced from the casing due to magnetostrictive vibration caused by the same alternating magnetic flux. Also, since the fixed contact is fixed to the hole provided at the center of the top of the casing, it is possible to support the fixed contact easily during initial assembly.

Further, since the steel case-mounting bolt projecting outward from the top center of the casing is fixedly attached, it is possible to mount the vacuum circuit interrupter at any desired position readily and securely.

Further, since the contact mounting formed from a separate member is fixed to the hole provided at the top center of the casing and since a threaded hole and a flange are provided for the contact mounting member, it is possible to raise the mechanical strength of the vacuum interrupter by forming the casing of a nonmagnetic, higher mechanical strength metal other than copper, to support the fixed contact readily during temporary assembly, and also to removably mount the casing mounting portion formed by a separate member in the threaded hole.

Further, since a shield is provided, it is possible to prevent metal vapour from adhering to the insulation disk and the bellows.

Further, since the vacuum circuit interrupter initially assembled by disposing brazing metals in position is heated to a temperature of 950°-1050° C. within a vacuum furnace to reduce the gas pressure to $10^{-4}$ Torr or less thus performing the degassing and the airtight sealing simultaneously, it is possible to obtain a desired circuit interrupter by a single brazing heating.

Further, since the copper forming the casing of the vacuum circuit interrupter deforms plastically when cooled gradually to room temperature within the vacuum furnace, it is possible to increase sufficiently the mechanical strength of the joined portion of the insulation disk.

Furthermore, since the movable side initially assembled with brazing metals disposed in position is heated to a temperature of 950°-1050° C. within a vacuum furnace to reduce the gas pressure to $10^{-4}$ Torr or less or a reduction gas atmosphere such as hydrogen gas thus performing the degassing and airtight sealing simultaneously, and next the fixed side initially assembled by disposing brazing metals appropriately is assembled with the movable side to initially assemble the whole vacuum circuit interrupter, and since the initially assembled whole vacuum circuit interrupter is then heated to a temperature of 500°-1050° C. within a vacuum furnace to reduce the gas pressure to $10^{-4}$ Torr or less thus performing the degassing and the airtight sealing simultaneously, it is possible to check the defective points of the airtight sealing parts of the movable side and any incorrect assembly. Further, since the temperature of the second brazing heating process is relatively low, it is possible to use a low-temperature vacuum furnace, thus increasing the life of the furnace and decreasing the cost.

It will be understood by those skilled in the art that the foregoing description is in terms of preferred embodiments of the present invention wherein various changes and modifications may be made without departing from the spirit and scope of the invention, as is set forth in the appended claims.

What is claimed is:

1. A vacuum interrupter, which comprises:

(a) a ceramic insulation disk having a hole at the center thereof;

(b) a bell-shaped metal casing having a fixed contact mounting portion projecting inwardly, an open end of said casing being joined hermetically by brazing to the outer periphery of said ceramic insulation disk to form a vacuum vessel, at least said open end of the casing being made of plastically deformable copper to thereby reduce thermal stress generated during cooling down of said casing to room temperature after said ceramic insulation disk has been brazed thereto;

(c) a fixed contact joined to a fixed contact mounting portion of said bell-shaped metal casing;

(d) a bellows disposed concentrically with said casing, one end of said bellows being joined hermetically to the inner surface of the disk near the central hole;

(e) a movable electrode rod having a movable contact mounting portion at one end thereof, said movable electrode rod being loosely inserted into the central hole of the ceramic insulation disk so as to be freely moveable, said movable electrode rod being joined hermetically to the other end of said bellows; and (f) a movable contact fixed to the contact mounting portion of said movable electrode rod, said movable contact being brought into contact with or away from said fixed contact when said movable electrode rod is moved together with said bellows to make or break a circuit connected therewith.

2. A vacuum interrupter as set forth in claim 1, wherein said bell-shaped metal casing is made of copper.

3. A vacuum interrupter as set forth in claim 1, wherein said bell-shaped metal casing comprises a stainless-steel bell-shaped casing including a copper ring-shaped stress reduction member located on the open end of said stainless-steel casing so as to be sandwiched between the open end of said casing and the outer periphery of said ceramic insulation disk.

4. A vacuum interrupter as set forth in claim 1 further comprising a casing mounting bolt having a base portion inserted into and jointed to hole formed in the fixed contact mounting portion of said bell-shaped metal casing, said fixed contact being also joined hermetically to the fixed contact mounting portion hole.

5. A vacuum interrupter as set forth in claim 1, wherein said fixed mounting contact portion is a fixed contact mounting member having a threaded hole at the center thereof and further includes a flange joined hermetically to the periphery of a hole formed at the top of said casing, said fixed contact being joined hermetically to the hole of said fixed contact mounting member.

6. A vacuum interrupter as set forth in claim 1, wherein said fixed contact mounting portion is integrally formed with said casing, said fixed contact being fixed into a recessed part of the contact mounting portion.

7. A vacuum interrupter as set forth in claim 4, wherein said casing-mounting bolt is integrally formed with said casing at the center thereof, projecting outwardly, to mount the circuit interrupter to a support.

8. A vacuum interrupter as set forth in claim 4, wherein said casing-mounting bolt is separately provided and fixed into a recessed part of said casing.

9. A vacuum interrupter as set forth in claim 1, further including a cup-shaped shield having a hole at the center thereof, one surface of the shield being fixed to said movable electrode rod to surround said fixed and movable contacts.

10. A vacuum interrupter as set forth in claim 1, further including a bell-shaped shield having a recessed top and a central hole, one surface of the top being fixed to said movable electrode rod to surround said fixed and movable contacts and said bellows.

11. A vacuum interrupter as set forth in claim 10, further including a second cup-shaped shield having a hole at the center thereof, one surface of a shield bottom thereof being fixed near said insulation disk hole.

* * * * *